US006238080B1

(12) United States Patent
Jarchau

(10) Patent No.: US 6,238,080 B1
(45) Date of Patent: May 29, 2001

(54) HOMOGENIZATION VALVE WITH OUTSIDE HIGH PRESSURE VOLUME

(75) Inventor: Michael Jarchau, Lubeck (DE)

(73) Assignee: APV North America, Inc., Wilmington, MA (US)

( * ) Notice: Subject to any disclaimer, the term of this patent is extended or adjusted under 35 U.S.C. 154(b) by 0 days.

(21) Appl. No.: 09/350,503

(22) Filed: Jul. 9, 1999

(51) Int. Cl.[7] ..... B01F 3/06

(52) U.S. Cl. ..... 366/176.2; 138/43; 137/625.3; 251/63.6

(58) Field of Search ..... 360/176.1, 176.2, 360/340; 138/42, 43; 137/625.3; 251/63.5, 63.6, 127, 121

(56) References Cited

U.S. PATENT DOCUMENTS

| | | | | |
|---|---|---|---|---|
| 1,925,787 | * | 9/1933 | Brooks | 366/176.2 |
| 3,133,557 | * | 5/1964 | Gongwer | 137/625.3 |
| 3,601,157 | | 8/1971 | Milleville et al. | 137/630.14 |
| 3,631,891 | | 1/1972 | Brumm | 137/625.3 |
| 3,746,041 | | 7/1973 | Friedland | 137/599 |
| 3,749,378 | | 7/1973 | Rhodes | 261/78 |
| 3,856,049 | * | 12/1974 | Scull | 138/43 |
| 3,894,716 | | 7/1975 | Barb | 251/127 |
| 3,920,044 | * | 11/1975 | Gruner | 138/43 |
| 4,004,613 | | 1/1977 | Purton et al. | 137/625.3 |
| 4,011,287 | | 3/1977 | Marley | 261/64 R |
| 4,024,891 | * | 5/1977 | Engel et al. | 138/42 |
| 4,079,754 | * | 3/1978 | Porter | 138/42 |
| 4,125,129 | | 11/1978 | Baumann | 137/625.3 |
| 4,205,696 | * | 6/1980 | Gongwer | 137/625.3 |
| 4,316,478 | * | 2/1982 | Gongwer | 173/625.3 |
| 4,348,116 | | 9/1982 | Bordas | 366/340 |
| 4,352,573 | | 10/1982 | Pandolfe | 366/176 |
| 4,383,769 | * | 5/1983 | Pandolfe | 366/337 |
| 4,410,430 | * | 10/1983 | Hagler, Jr. | 138/42 |
| 4,429,714 | | 2/1984 | Hughes et al. | 137/625.3 |
| 4,531,548 | | 7/1985 | Gottling et al. | 137/627.5 |
| 4,667,699 | | 5/1987 | Löliger | 138/31 |
| 4,860,993 | | 8/1989 | Goode | 251/127 |
| 4,938,450 | | 7/1990 | Tripp et al. | 251/30.03 |
| 4,944,602 | | 7/1990 | Buschelberger | 366/337 |
| 4,952,067 | * | 8/1990 | Dallas | 366/340 |
| 5,018,703 | | 5/1991 | Goode | 251/127 |
| 5,113,908 | | 5/1992 | Steinke | 137/625.3 |
| 5,309,934 | | 5/1994 | Jaeger | 137/1 |
| 5,672,821 | | 9/1997 | Suzuki | 73/202 |
| 5,692,684 | | 12/1997 | Zurmühlen | 239/563 |
| 5,749,650 | | 5/1998 | Kinney et al. | 366/176.2 |
| 5,782,557 | | 7/1998 | Young | 366/176.2 |
| 5,887,971 | | 3/1999 | Gandini et al. | 366/176.2 |
| 5,899,564 | * | 5/1999 | Kinney et al. | 366/176.2 |

FOREIGN PATENT DOCUMENTS

| | | |
|---|---|---|
| 524 345 | 9/1921 | (FR) . |
| WO 00/15327 | 3/2000 | (WO) . |

OTHER PUBLICATIONS

Leslie W. Phipps; "Effects of main flow reversal in a simple homogenizing valve"; Journal of Dairy Research; pp. 525–528; Mar. 1978.

* cited by examiner

*Primary Examiner*—Tony G. Soohoo
(74) *Attorney, Agent, or Firm*—Hamilton, Brook, Smith & Reynolds, P.C.

(57) ABSTRACT

A homogenization valve includes a housing and stacked valve members within the housing. The valve members have central holes therethrough defining a low pressure volume. Each valve member includes a valve seat defining with a valve surface, gaps through which fluid is expressed radially from an outside high pressure volume to the central low pressure volume. The actuator acts on the valve members to control the width of the gaps. A counterbalancing mechanism reduces the amount of actuator force required to maintain a predetermined homogenization pressure.

34 Claims, 10 Drawing Sheets

HOMOGENIZATION VALVE WITH OUTSIDE HIGH PRESSURE VOLUME

The present application is related to U.S. application Ser. No. 09/351,043 entitled "FORCE ABSORBING HOMOGENIZATION VALVE" by Michael Jarchau and Ser. No. 09/350,504 entitled "IMPROVED VALVE MEMBERS FOR A HOMOGENIZATION VALVE" by Michael Jarchau, Harald 0. Korstvedt, and Blaine Potter, both applications being filed concurrently with the present application and incorporated herein in their entirety by this reference.

BACKGROUND OF THE INVENTION

Homogenization is the process of breaking down and blending components within a fluid. One familiar example is milk homogenization in which milk fat globules are broken-up and distributed into the bulk of the milk. Homogenization is also used to process other emulsions such as silicone oil and process dispersions such as pigments, antacids, and some paper coatings.

The most common device for performing homogenization is a homogenization valve. The emulsion or dispersion is introduced under high pressure into the valve, which functions as a flow restrictor to generate intense turbulence. The high pressure fluid is forced out through a usually narrow valve gap into a lower pressure environment.

Homogenization occurs in the region surrounding the valve gap. The fluid undergoes rapid acceleration coupled with extreme drops in pressure. Theories have suggested that both turbulence and cavitation in this region are the mechanisms that facilitate the homogenization.

Early homogenization valves had a single valve plate that was thrust against a valve seat by some, typically mechanical or hydraulic, actuating system. Milk, for example, was expressed through an annular aperture or valve slit between the valve and the valve seat.

While offering the advantage of a relatively simple construction, the early valves could not efficiently handle high milk flow rates. Homogenization occurs most efficiently with comparatively small valve gaps, which limits the milk flow rate for a given pressure. Thus, higher flow rates could only be achieved by increasing the diameter or size of a single homogenizing valve.

Newer homogenization valve designs have been more successful at accommodating high flow rates while maintaining optimal valve gaps. Some of the best examples of these designs are disclosed in U.S. Pat. Nos. 4,352,573 and 4,383,769 to William D. Pandolfe and assigned to the instant assignee, the teachings of these patents being incorporated herein in their entirety by this reference. Multiple annular valve members are stacked one on top of the other. The central holes of the stacked members define a common, high pressure, chamber. Annular grooves are formed on the top and/or bottom surfaces of each valve member, concentric with the central hole. The grooves are in fluid communication with each other via axially directed circular ports that extend through the members, and together the grooves and ports define a second, low pressure, chamber. In each valve member, the wall between the central hole and the grooves is chamfered to provide knife edges. Each knife edge forms a valve seat spaced a small distance from an opposed valve surface on the adjacent valve member. In this design, an optimal valve spacing can be maintained for any flow rate; higher flow rates are accommodated simply by adding more valve members to the stack. Such systems have required high actuator forces and resulting pressures, for example, approximately 500 to 1,000 psi, to maintain the homogenization pressure in the homogenization valve.

SUMMARY OF THE INVENTION

In accordance with aspects of the present invention, the homogenization valve includes a housing and stacked valve members within the housing. The valve members have central holes therethrough defining a low pressure volume. Each valve member includes a valve seat defining, with a valve surface, gaps through which fluid is expressed radially from an outside high pressure volume to the central low pressure volume. The actuator acts on the valve members to control the width of the gaps.

With the homogenized fluid flowing from the outer high pressure volume radially inward, the valve members or rings are placed in compression, for improved durability, at the cost of potentially requiring a stronger and heavier valve housing. Further, the arrangement lends itself to counterbalancing of the high pressure forces applied axially against the valve assembly.

The homogenization valve may include at least one counterbalancing mechanism which reduces the amount of actuator force required to maintain a predetermined homogenization pressure. Thus, preexisting actuators can be used for applications, such as silicone emulsions in coating fabrics, which require even higher actuator force than presently available. As a consequence of the reduced actuator force that is required, pneumatic actuators that use conventional air supply devices, for example, 85 psi, can be used in accordance with the present invention. Pneumatic actuators eliminate the need for an electric pump, a heat exchanger including cooling coils, and other accessories associated with hydraulic actuators.

The counterbalancing mechanism includes an axially directed surface exposed to the outside high pressure volume to substantially counterbalance forces from the outside high pressure volume against the actuator. In one preferred embodiment, the actuator urges a force transfer member interposed between the actuator and the valve member, and the force transfer member includes the axially directed surface.

In accordance with another aspect of the present invention, annular springs that align adjoining pairs of valve members are positioned within spring-grooves in the valve members. Preferably, the springs are positioned in the high pressure volume so that the springs are exposed to less turbulent flow. In a preferred embodiment, an aligning member, such as a rod, is provided to maintain angular alignment of the stack of valve members.

In accordance with yet other aspects of the present invention, the valve members include integral spacing elements to maintain the gaps at predetermined widths wherein the actuator adjusts the width of substantially all of the gaps by compressing the spacing elements. The spacing elements can be formed from a first material such as stainless steel and the valve seats and valve surfaces can be formed from a second material such as tungsten-carbide. This configuration minimizes wear of the valve seat and surface while allowing compression of the spacing elements to maintain the valve gaps.

A flow restrictor may be provided on the outlet of the homogenization valve to create back pressure therein. The valve further includes an axially directed surface exposed to the back pressure to substantially counterbalance forces from the back pressure against the actuator. The actuator can be hydraulic or pneumatic actuator.

The above and other features of the invention including various novel details of construction and combinations of parts, and other advantages, will now be more particularly described with reference to the accompanying drawings and pointed out in the claims. It will be understood that the particular method and device embodying the invention are shown by way of illustration and not as a limitation of the invention. The principles and features of this invention may be employed in various and numerous embodiments without departing from the scope of the invention.

BRIEF DESCRIPTION OF THE DRAWINGS

In the accompanying drawings, reference characters refer to the same parts throughout the different views. The drawings are not necessarily to scale; emphasis has instead been placed upon illustrating the principles of the invention. Of the drawings.

DETAILED DESCRIPTION OF THE PREFERRED EMBODIMENTS

Figure 1:
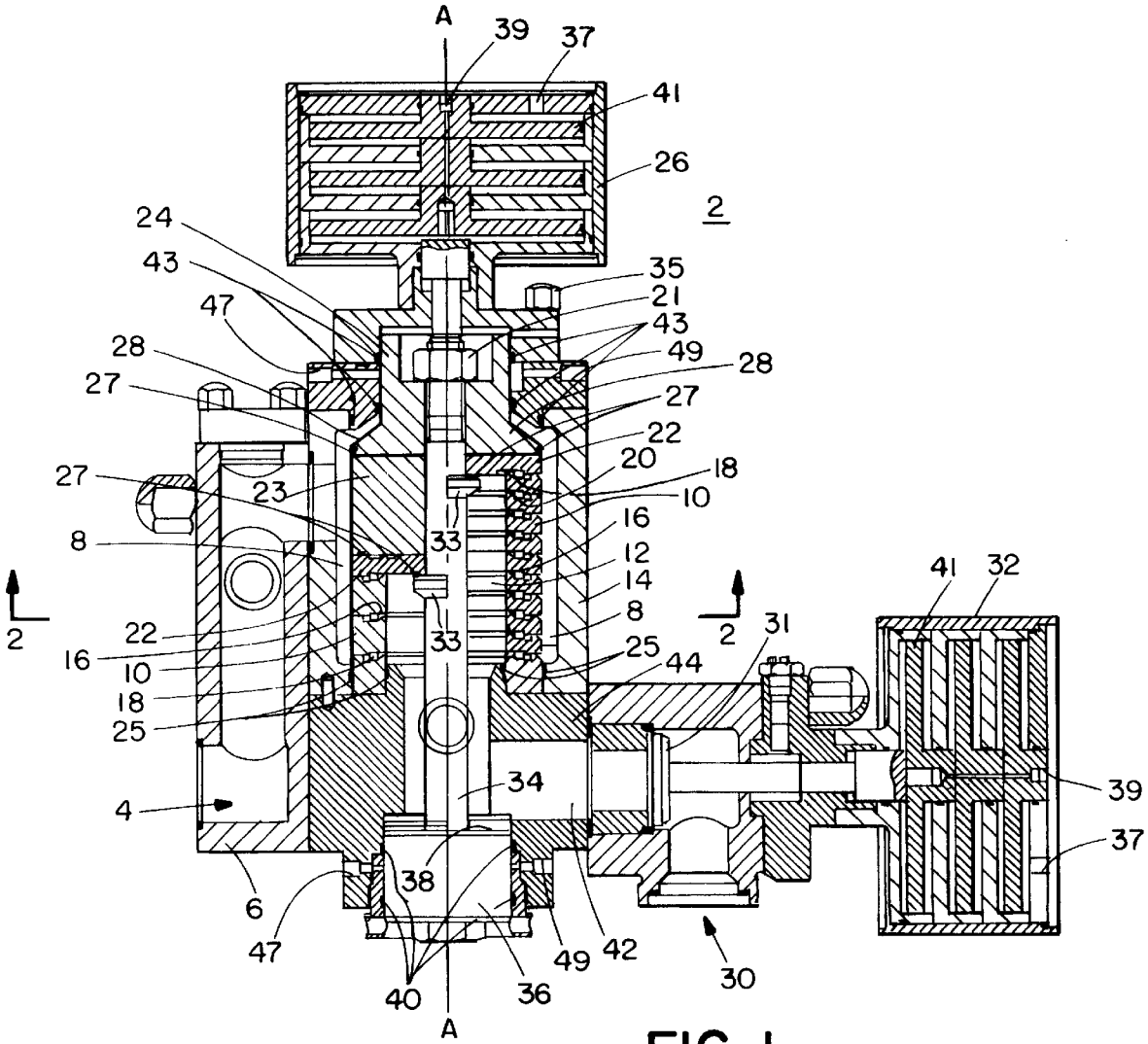
FIG. 1 is a cross sectional view of a preferred embodiment of a hydraulically balanced homogenization valve in accordance with the present invention.

FIG. 1 is a cross sectional view of a hydraulically balanced primary valve assembly 2 for use in a homogenizing system (complete system not shown) that has been constructed according to the principles of the present invention.

Emulsion or dispersion to be homogenized is pumped at high pressure by a pump (not shown) and delivered to inlet port 4 of an inlet flange 6 where it is directed to an outer high pressure chamber or volume 8. Valve members 10, which are generally annular and have central holes therethrough to form a low pressure inner chamber or volume 12, are stacked on one another within housing 14. The high pressure fluid or liquid from high pressure chamber 8 is expressed through valve gaps or slits 16 into the low pressure chamber 12. The fluid passing into the low pressure chamber 12 enters an outlet port 42 of an outlet flange 44.

Two different embodiments of the invention are shown on either side of longitudinal axis A-A, the one on the left having three valve gaps 16 and the one of the right having ten gaps. The number of gaps is controlled by choosing different sets of valve members placed in the assembly. The gaps 16 provided between each valve member pair form a restricted passageway through which the emulsion or dispersion is expressed to the low pressure chamber 12. The gaps 16 can be constructed according to that illustrated in FIG. 3 of the '769 patent. Preferably, the gaps 16 are constructed according to those disclosed in commonly assigned U.S. Pat. No. 5,749,650, filed Mar. 13, 1997, and U.S. Pat. No. 5,899,564 filed May 11, 1998, the contents of both patents being incorporated herein in their entirety by this reference.

More specifically, the height of the gap 16 is preferably between 0.0013 and 0.0018 inches, usually about 0.0015 inches, but in any event less than 0.003 inches. This dimension is defined as the vertical distance between the valve seat or land and the opposed, largely flat, valve surface. Experimentation has shown that the gap should not be simply increased beyond 0.003 inches to obtain higher flow rates since such increases will lead to lower homogenization efficiencies.

In the preferred embodiment, the valve seat is a knife-edge configuration. With reference to FIGS. 10–13, on the upstream, high pressure side of the gap, the valve seat or land 52 is chamfered at 45° angle sloping toward the valve surface 51. In the gap, the valve seat 52 is flat across a distance of ideally approximately 0.015 to 0.020 inches, but less than 0.06 inches. On the downstream, low pressure side of the gap 16, the valve seat 52 slopes away from the valve surface 51 at an angle from 5 to 90° or greater, approximately 60° in the illustrated embodiment. As particularly illustrated in FIG. 12, the valve surface 51 is similarly constructed. The downstream terminations of valve surfaces overlap valve seats or lands by no more than 0.025 inches. Preferably, the downstream terminations of the valve surfaces 51 overlap the valve seats 52 by at least a height of the valve gaps 16. It has also been found that no overlap between the valve seats 52 and valve surfaces 51 can be effective as well.

Returning to FIG. 1, the stack of valve members 10 is sealed against the outlet flange 44 at its lower end by O-rings 25. The top-most valve member 10 engages top plate 22 that seals across the inner chamber 12. Top plate 22 is hydraulically or pneumatically urged by actuator 26 via intermediate force transfer member 24. A nut 21 is provided on actuator rod 34 to transfer the downward force to member 24. By varying the pressure of a hydraulic fluid or pneumatically in actuator 26, the pressure applied to top plate 22 and hence valve members 10 by actuator rod 34 can be dynamically adjusted to control the size of the valve gap 16. Actuator rod 34 includes a shoulder 33 to clamp the top plate 22 and member 24 together (and additionally the spacer 23 on the left side of the embodiment) by tightening nut 21. O-rings 27 provide a fluid seal between shoulder 33 and top plate 22 and between the top plate and member 24. O-rings 43 further provide a fluid seal between the housing 14, member 24, and the actuator 26.

Actuator 26 is secured to the main housing 14 of the valve assembly 2 by bolts 35, studs and nuts, or other suitable fastening means. Preferably, actuator 26 is a three-stage pneumatic actuator having an inlet port 37 and an outlet port 39. As understood in the art, the inlet port 37 receives compressed air where it is directed to three plates 41 to increase the surface area on which the compressed air can act upon. Low pressure is created under each plate 41 via outlet port 39.

It is known that the valve gaps increase with use of the valve as the fluid wears down the valve seat and valve surfaces. This results in a decreased pressure differential between the outer high pressure chamber 8 and the low pressure chamber 12. Consequently, the fluid may not be properly homogenized. Prior art systems have employed the actuator to apply an increased downward force to close the desired number of valve gaps (e.g., usually two or three valve gaps to maintain a constant flow area). For example, as disclosed in the '769 patent, the downward force flexes the top valve members to close the desired number of valve gaps to adjust the pressure differential.

The inventive valve members 10 of the present invention include spacing elements or pads which allow the valve members to be compressed by the actuator 26 such that substantially all the valve gaps 16 are adjusted to compensate for wear. This has the advantage of maintaining a predetermined (and often optimized) separational distance between the valve seat and valve surface as wear occurs.

FIGS. 8–13 illustrate exemplary spacer pads 50 that form part of valve member 10. Area 57 is machined off leaving the spacer pads 50. Valve members 10 are stacked on one another with spacer pads 50 of one valve member contacting the underside 53 of a contiguous valve member to form the valve gaps 16 between the valve seat 52 and opposing valve surface 51. Alternatively, spacers pads 50 can be a separate element coupled to or positioned adjacent the valve members 10. The spacer pads 50 are small enough such that they can be compressed by the actuator 26. In a preferred embodiment of the present invention, each spacer pad 50 has a surface area of approximately 11 $mm^2$ that touches the underside 53 of a contiguous valve member 10 when assembled. This allows each spacer pad 50 to be compressed up to about 0.002 inches (0.0508 mm).

Figure 14:
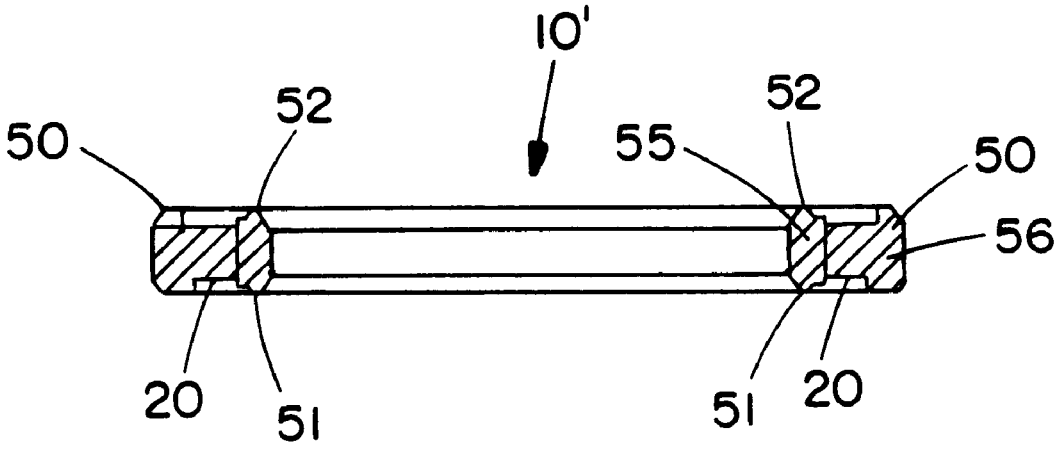
FIG. 14 is an alternative embodiment of a valve member of FIGS. 8–13.

FIG. 14 illustrates an alternative embodiment of the valve member, designated by reference numeral 10'. The valve member 10' is formed at least two materials: a hard, durable material adjacent the valve seat and surface to minimize wear thereof and a relatively soft, compressible material adjacent the spacer pads 50 to allow compression thereof. Preferably, an inner ring 55 of a relatively hard material, such as tungsten-carbide, is inserted into an outer ring 56 of softer material, such as stainless steel. In a preferred embodiment, the hard material has a Rockwell A-scale hardness number of greater than 90 and the compressible material has a Rockwell A-scale hardness number of not greater than 80. The rings 55, 56 are maintained in position by an interference fit or other suitable methods, such as welding.

Figure 2:
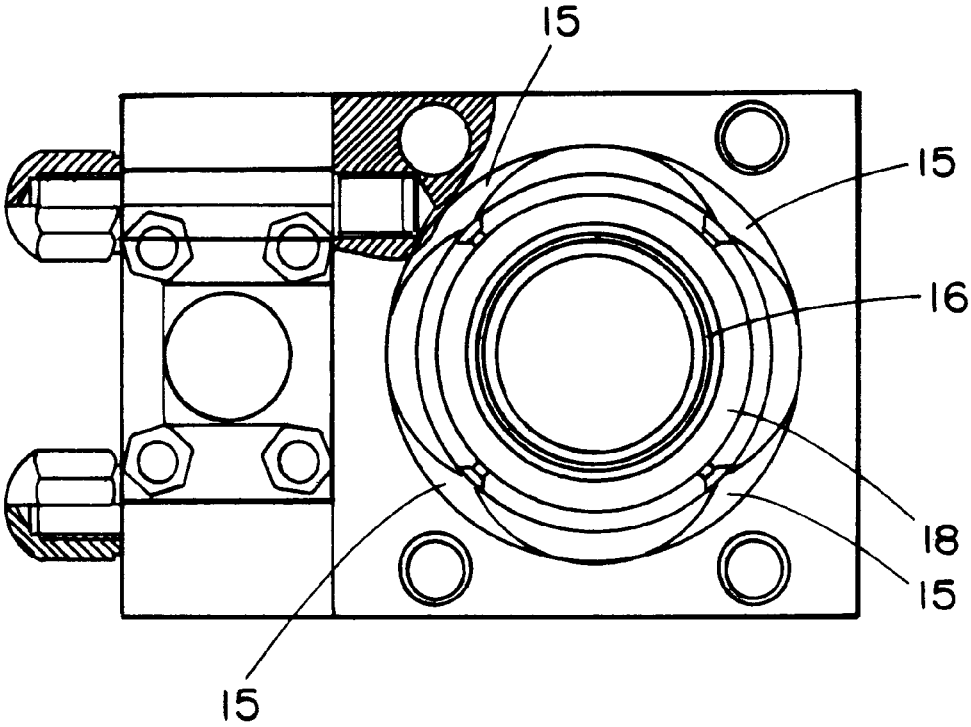
FIG. 2 is a cross sectional view taken along line 2—2 of FIG. 1.

The valve members 10 are aligned with respect to each other and maintained in the stack formation by serpentine or wave valve springs 18 that are confined within cooperating spring-grooves 20 formed in each valve member. The valve springs 18 also spread the valve members 10 apart to increase the valve gaps 16 when the actuating pressure is reduced in a valve cleaning operation. Additionally, four lobes 15 or projections from housing 14 help maintain alignment of the stack of valve members as specifically shown in FIG. 2. Furthermore, the valve spring 18 ends can be bent, for example, 90 degrees, and inserted into machined notches or pockets 58 (see FIG. 8) in adjacent valve members such that the stack of valve members maintains preferable angular alignment. Such a configuration prevents rotation of the valve members 10 relative to one another. That is to say, the spacer pads 50 are aligned in vertical rows when preferably aligned.

It is also significant that the valve springs 18 are positioned upstream from the valve gaps 16, i.e., on the high pressure side of the valve gaps. Prior art designs have expressed the fluid into a closed environment between the valve members. In the present invention, however, the high pressure fluid passes through the spring region before being expressed through the valve gaps 16. Accordingly, the turbulent expressed fluid is in the open chamber 12 and not over the springs, an arrangement which has been found to reduce chatter of the valve members 10. Chattering of the valve members 10 is undesirable as such can damage the valve members, emit noise, and produce other deleterious effects in the operation of the valve 2.

The high pressure of the fluid causes an upward force on the top plate 22 on an annular surface thereon extending from the valve gaps 16 outward toward chamber 8. This upward force is counteracted by a downward force from the actuator 26. More specifically, the actuator 26 exerts a force on member 24 which in turn exerts a force on the top plate 22 (and additionally via a spacer 23 on the left side embodiment).

A counterbalancing mechanism is provided to reduce the net upward force caused by the fluid on the actuator 26. A preferred mechanism provides an axially directed surface 28 (see FIG. 1) on member 24 which allows the high pressure fluid in chamber 8 to push downward, thereby reducing the overall upward force on the actuator 26. Thus, a lower actuator pressure is required to counteract the upward force caused by the fluid. Consequently, a smaller, and typically less expensive actuator, can be employed and less energy is consumed. Additionally, the same actuator can be used for other applications which require higher actuator force than presently required.

Prior art systems, such as that disclosed in '769 patent, express fluid from an inside, high pressure chamber to a low pressure chamber outside the valve members. The configuration of these systems makes it exceptionally difficult to fully counterbalance the upward pressure because any counterbalancing surface must be positioned between the knife edges. Thus, there will be some upward force. Full counterbalancing of the high pressure region of the present valve, at the expense of a stronger housing, allows the same actuator to accommodate higher homogenization pressure used in applications such as silicone emulsions in coating fabrics.

Steam ports 47, 49 are provided above and below the stack of valve members 10, as illustrated in FIG. 1, to provide sterility in valve 2. More particularly, steam or other suitable sterile fluid is passed at high pressure into inlet ports 47 and passed around member 24 at the top and piston 36 at the bottom where the fluid exits outlet ports 49. In this manner, contamination of the homogenized fluid due to potential fluid leaks is minimized.

The valve may further be provided with a single stage valve 30 at the outlet flange 44 that provides back pressure in chamber 12. Theories suggest that such back pressure suppresses cavitation and increases turbulence in chamber 12, thereby increasing the efficiency of the valve 2. The preferred back pressure is between 5% and 20% of the pressure at the inlet port 4. A back pressure of about 10% has been found particularly suitable. Valve 30 includes a plunger 31 urged by actuator 32 to restrict the outlet flow. Other suitable flow restrictors can be employed in accordance with the present invention.

If valve 30 is employed, significant back pressure may result in chamber 12 which causes an upward force (i.e., force exerted on top plate 22 between the valve gaps 16) on the actuator 26. To reduce this upward force, actuator rod 34 extends from the actuator 26 at its upper end to a piston 36 at its lower end. Piston 36 includes an annular surface 38 on which the fluid in chamber pushes downward which counteracts the upward force. Preferably, the inside diameter of piston 36 approximates the distance between valve gaps, i.e, across central volume 12. Piston 36 is sealed to the valve 2 by O-rings 40. Thus, a second counterbalancing mechanism is provided to reduce the force of back pressure on the actuator 26.

Figure 3:
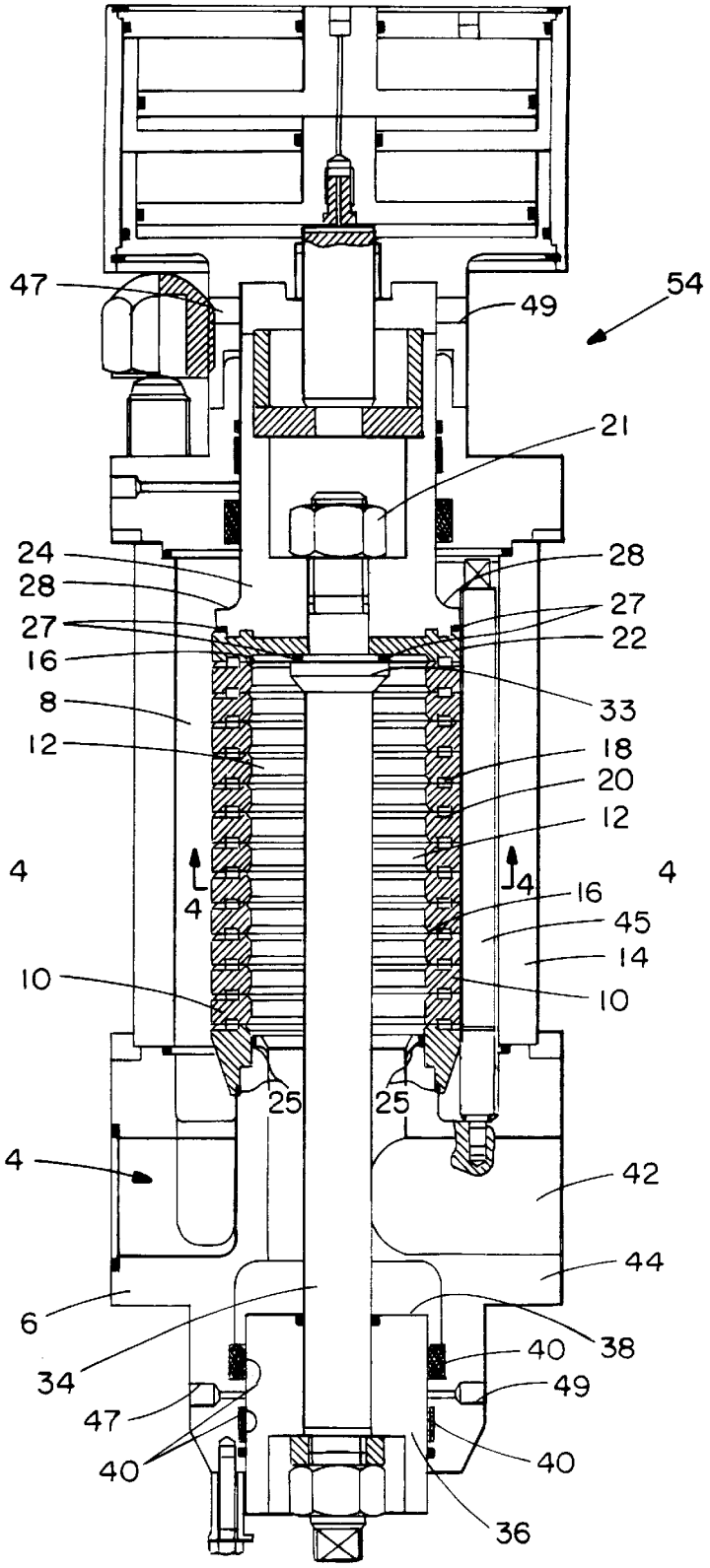
FIG. 3 is a partial cross sectional view of another preferred embodiment of a hydraulically balanced homogenization valve in accordance with the present invention.
Figure 4:
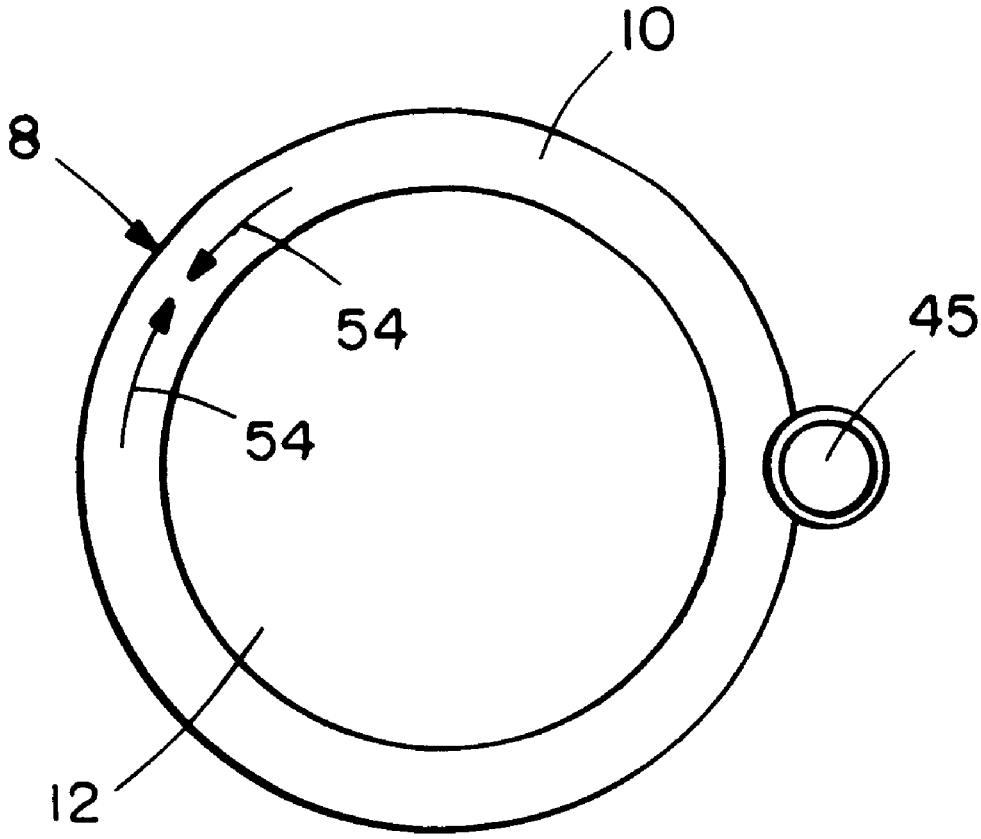
FIG. 4 is a cross sectional view taken along 4—4 of FIG. 3.

FIG. 3 illustrates another preferred embodiment of a hydraulically balanced homogenization primary valve 54 wherein like reference numerals refer to the same or similar elements. Valve 54 includes an aligning member or rod 45 to maintain angular alignment of the stack of valve members 10. As shown in FIG. 4, each valve member 10 includes a groove on the periphery which accepts the rod 45, thereby maintaining alignment of the valve members.

Because the high pressure chamber 8 is on the outside of the generally annular valve members 10, the inward radial force places each element of the valve member 10 in compression as illustrated by arrows 54 in FIG. 4. Other systems, such as that disclosed in the '769 patent, have the high pressure chamber on the inside of the valve members resulting in an outward radial force which places the valve members in tension. Because valve members 10 are typically formed of a hardened, brittle material, they withstand compressive forces much better than tensile forces, making the design of the present invention more durable.

Figure 5:
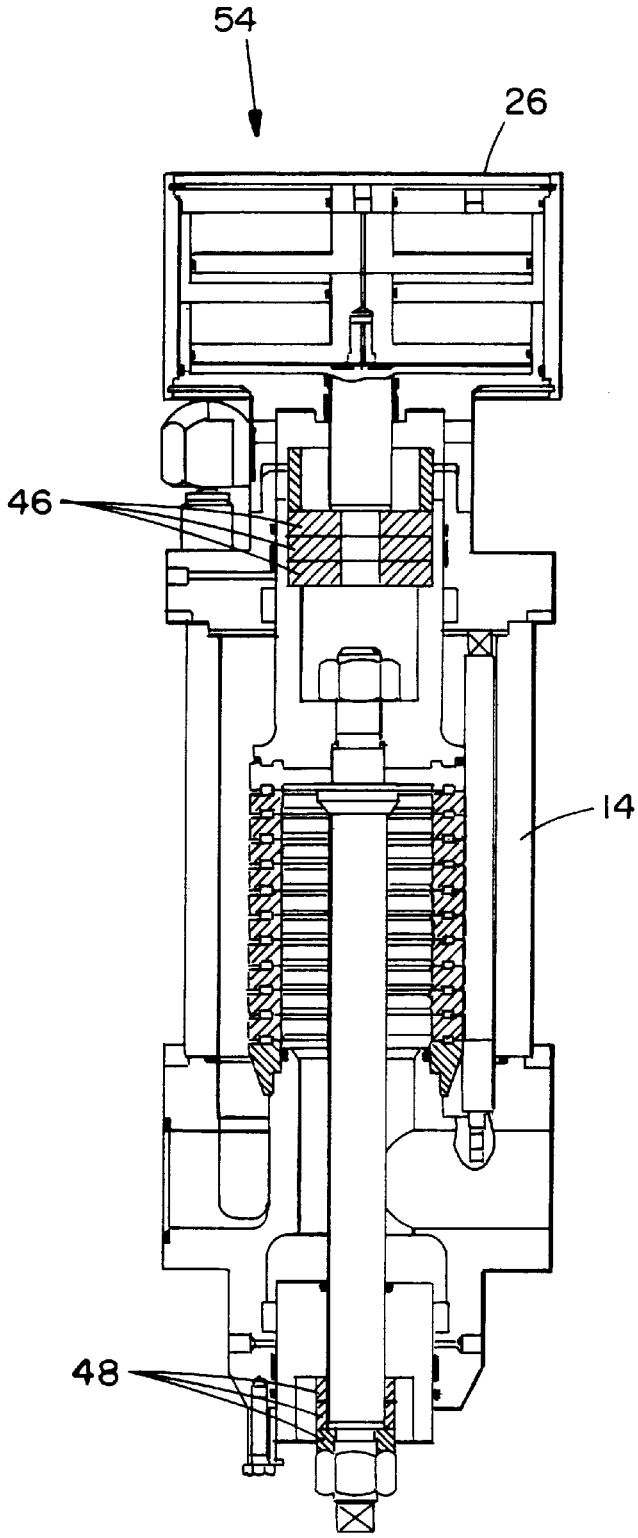
FIGS. 5–7 illustrate the housing of a homogenizing valve shown in FIG. 3 accommodating varying numbers of valve members.
Figure 6:
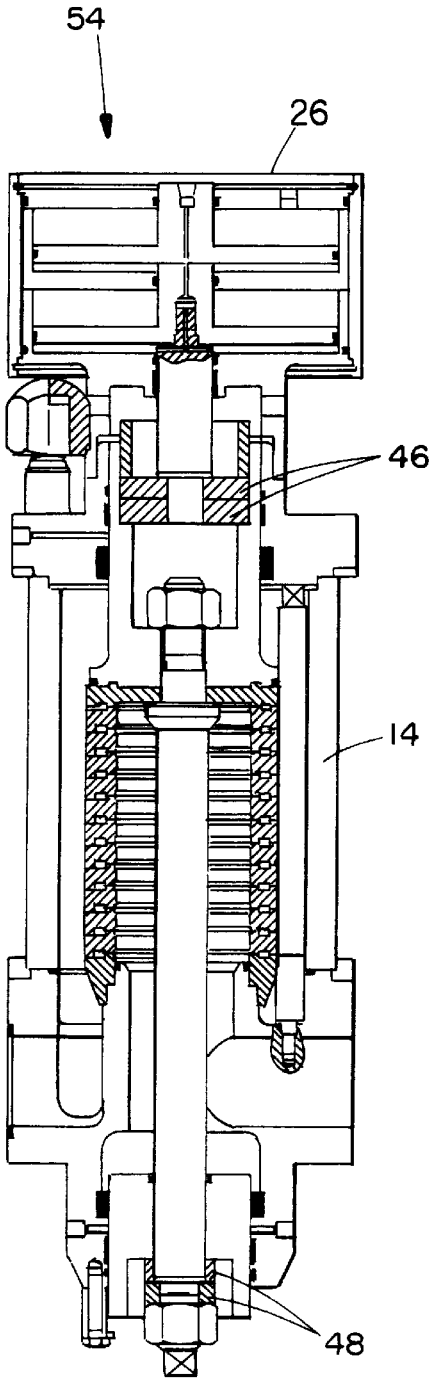
Figure 7:
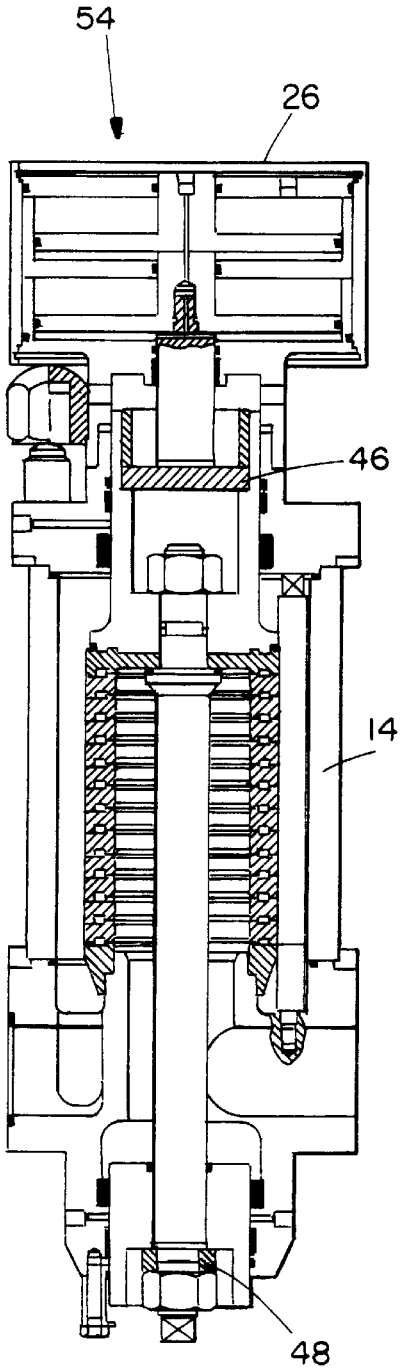
Figure 8:
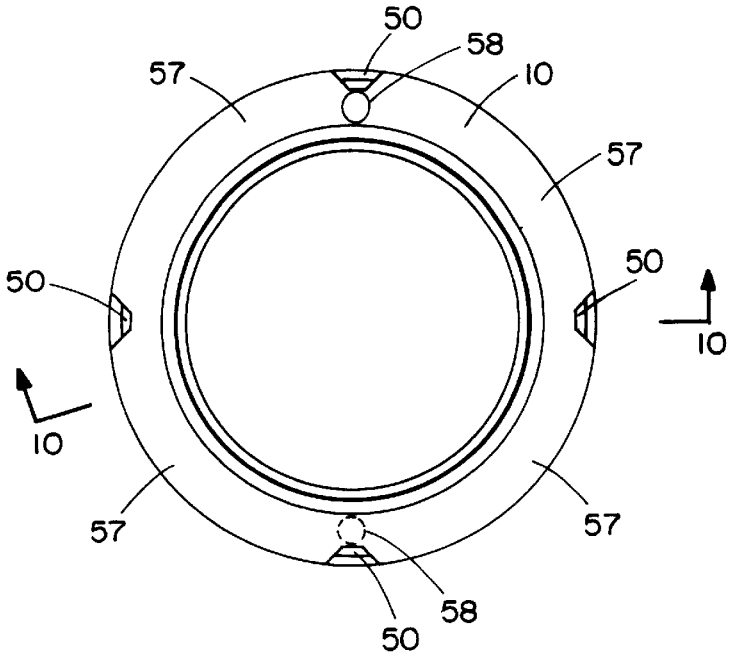
FIG. 8 is a plan view of an exemplary valve member with spacer pads in accordance with the present invention.
Figure 9:
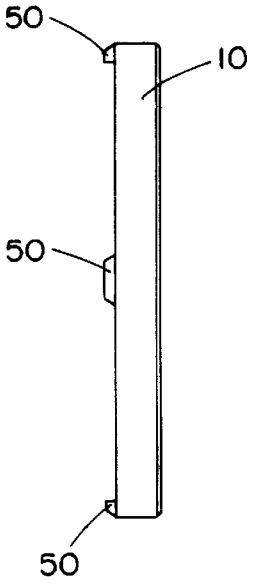
FIG. 9 is a side view of the valve member shown in FIG. 8.
Figure 10:
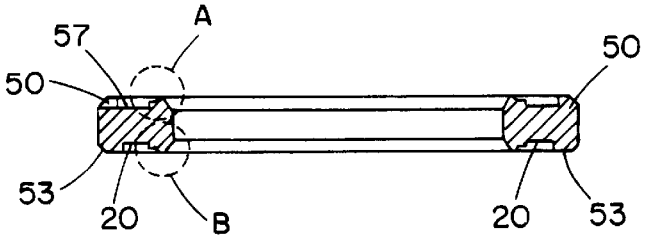
FIG. 10 is a cross sectional view taken along line 10—10 of FIG. 8.
Figure 11:
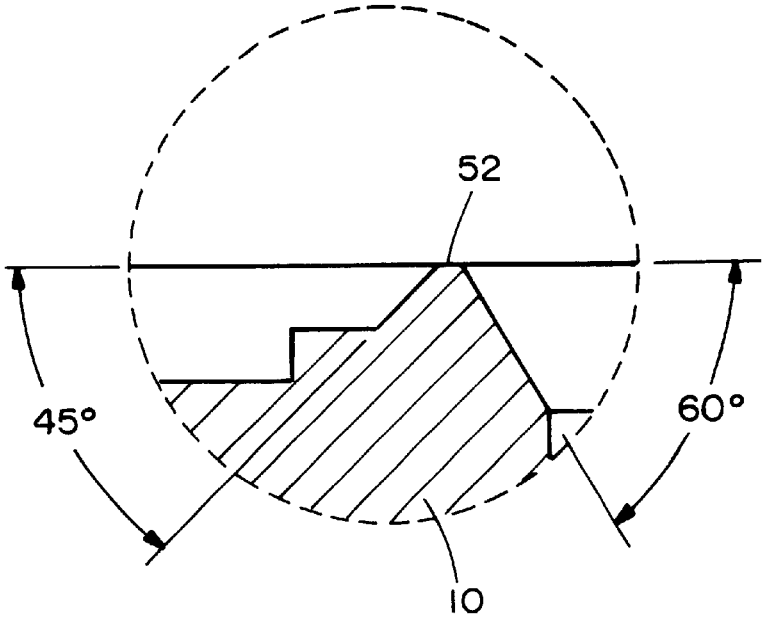
FIG. 11 is an enlarged view of the encircled area referenced as "A" of FIG. 10.
Figure 12:
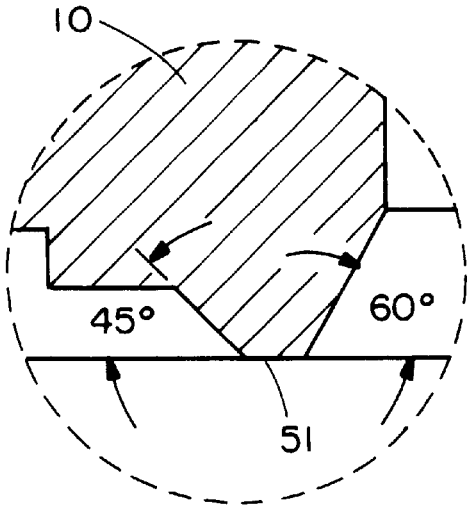
FIG. 12 is an enlarged view of the encircled area referenced as "B" of FIG. 10.
Figure 13:
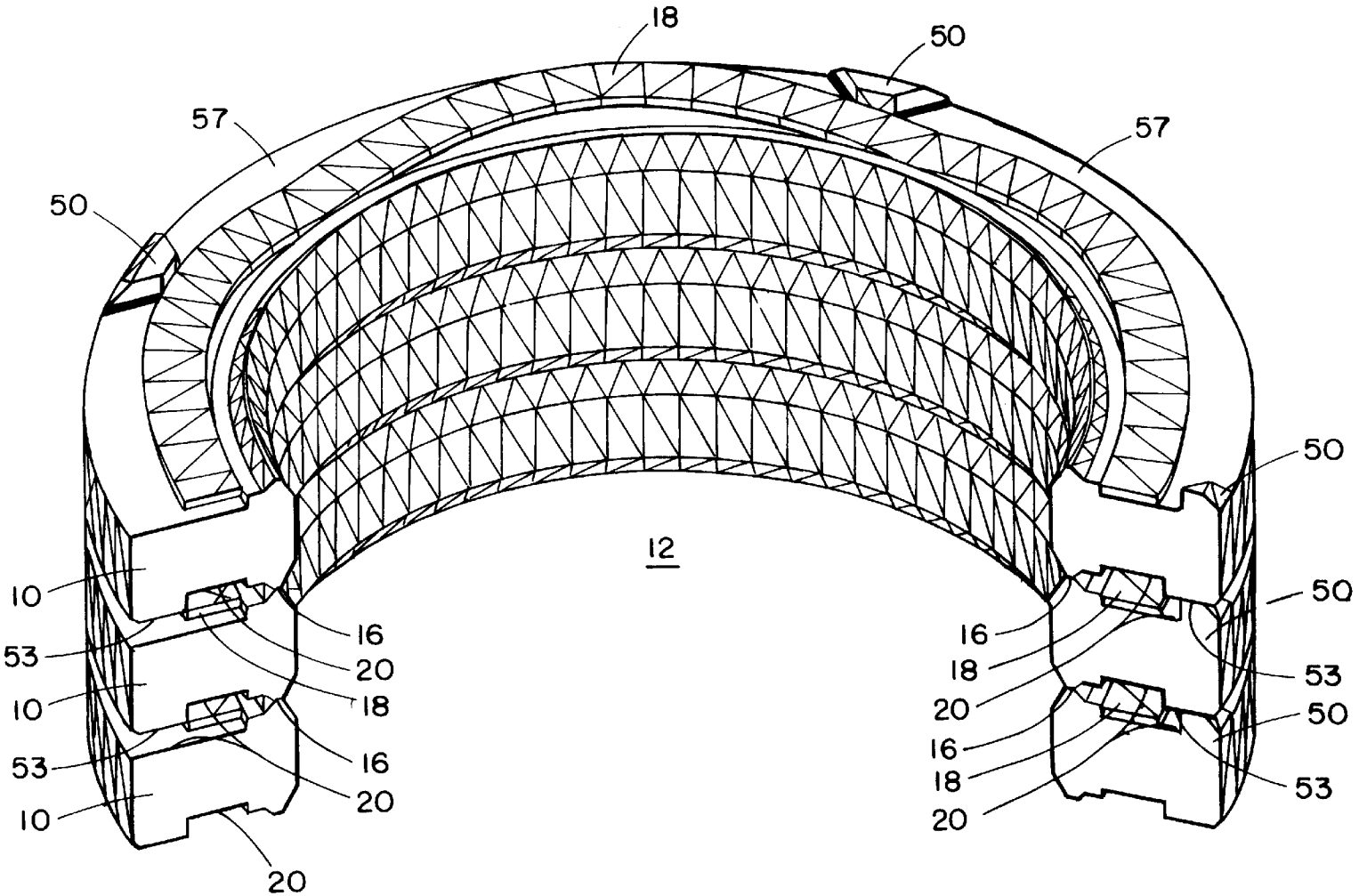
FIG. 13 is a cross sectional isometric view of the valve members of FIG. 1.

Beneficially, the same housing 14 can accommodate different applications, which may require a different number of valve gaps 16 to vary throughput rates and homogenization pressures, as illustrated in FIGS. 5–7. More particularly, by inserting and removing bottom spacers 48 and top spacers 46, respectively, the total number of valve gaps 16 can be modified using the same housing 14. FIGS. 5–7 illustrate 11, 12, and 13 valve gaps, respectively.

While this invention has been particularly shown and described with references to preferred embodiments thereof, it will be understood by those skilled in the art that various changes in form and details may be made therein without departing from the spirit and scope of the invention as defined by the appended claims.

What is claimed is:

1. A homogenizing valve for homogenizing a fluid, comprising:

a housing;

a valve member within the housing and having a valve seat defining, with a valve surface, a gap through which fluid is expressed radially from a high pressure source from an outside high pressure volume to a central low pressure volume to homogenize the fluid, the change in pressure and geometry of the gap causing the fluid to be homogenized; and an actuator which acts on the valve member to deform the valve member and thus control the width of the gap.

2. The valve of claim 1, further comprising an axially directed surface exposed to the outside high pressure volume to substantially counterbalance forces from the outside high pressure volume against the actuator.

3. The valve of claim 2, wherein the actuator urges a force transfer member interposed between the actuator and the valve member, the force transfer member including the axially directed surface.

4. The valve of claim 1, further comprising annular springs that align adjoining pairs of valve members, the springs positioned within spring-grooves in the valve members.

5. The valve of claim 4, wherein the springs are positioned in the high pressure volume.

6. The valve of claim 4, wherein each spring has a first end and a second end, each end being bent at an angle and positioned in notches of adjacent valve members to maintain angular alignment of the valve members.

7. The valve of claim 1, further comprising:

a plurality of valve members to form a plurality of valve gaps; and a plurality of circumferentially spaced, deformable spacing elements between the valve surfaces and valve seats that deform to maintain the valve gaps.

8. The valve of claim 7, wherein the spacing elements are integral to the valve members.

9. The valve of claim 7, wherein the actuator adjusts the width of substantially all of the gaps by deforming the spacing elements.

10. The valve of claim 7, wherein the spacing elements are formed from a first material and the valve seats and valve surfaces are formed from a second material.

11. The valve of claim 10, wherein the first material is stainless steel and the second material is tungsten-carbide.

12. The valve of claim 1, further comprising a flow restrictor that restricts the outlet of a fluid from the valve to create back pressure in the valve.

13. The valve of claim 12, further comprising a piston connected to the actuator, the piston including an axially directed surface exposed to the back pressure to substantially counterbalance forces from the back pressure against the actuator.

14. The valve of claim 1, further comprising a plurality of valve members stacked on one another and an aligning member that maintains angular alignment of the valve members.

15. The valve of claim 14, wherein the aligning member includes a rod.

16. The valve of claim 1, wherein the actuator is a hydraulic actuator.

17. The valve of claim 1, wherein the actuator is a pneumatic actuator.

18. A homogenizer valve comprising a stack of annularly-shaped valve members having central holes defining a low pressure volume, the valve members homogenizing a fluid as it passes from a high pressure volume radially inward through intervening annular valve gaps defined by opposed valve surfaces and valve seats, the change in pressure and geometry of the valve gaps causing the fluid to be homogenized, the valve members being deformable to control the width of the valve gaps.

19. The valve of claim 18, further comprising:

an actuator that controls the width of the valve gaps; and a counterbalancing mechanism that substantially counterbalances forces from the high pressure volume against the actuator.

20. The valve of claim 18, further comprising:

a flow restrictor that restricts the outlet of a fluid from the valve to create back pressure in the same; and a counterbalancing mechanism that substantially counterbalances forces from the back pressure against the actuator.

21. The valve of claim 18, further comprising annular springs that align adjoining pairs of valve members, the springs positioned within spring-grooves in the valve members in the high pressure volume.

22. The valve claim 21, wherein each spring has a first end and a second end, each end being bent at an angle and positioned in notches of adjacent valve members to maintain angular alignment of the valve members.

23. The valve of claim 18, further comprising a plurality of circumferentially spaced, deformable spacing elements between the valve surfaces and valve seats to control the width of the valve gaps.

24. The valve of claim 23, wherein the spacing elements are integral to the valve members.

25. A valve assembly for homogenizing or mixing a fluid comprising valve members stacked within a housing and defining a central low pressure volume and a peripheral high pressure volume within the housing, at least one of the valve members having a valve seat spaced from an adjacent valve member by deformable spacing elements to provide a gap through which fluid is expressed, wherein an actuator controls the width of the gap by deforming substantially all of the spacing elements.

26. The valve assembly of claim 25, further comprising, a counterbalancing mechanism that substantially counterbalances forces from the high pressure volume against the actuator.

27. The valve assembly of claim 25, further comprising:

a flow restrictor that restricts the outlet of a fluid from the valve assembly to create back pressure in the same; and a counterbalancing mechanism that substantially counterbalances forces from the back pressure against the actuator.

28. The valve assembly of claim 25, further comprising annular springs that align adjoining pairs of valve members, the springs positioned within spring-grooves in the valve members in the high pressure volume.

29. The valve assembly of claim 28, wherein each spring has a first end and a second end, each end being bent at an angle and positioned in notches of adjacent valve members to maintain angular alignment of the valve members.

30. A method of homogenizing a fluid, comprising:

expressing a fluid through a gap from an outside high pressure volume to a low pressure volume inside a plurality of valve members to homogenize the fluid; and controlling the width of the gap with an actuator by deforming at least one valve member.

31. The method of claim 30, further comprising substantially counterbalancing a force from the outside high pressure volume against the actuator.

32. The method of claim 30, further comprising:

restricting the outlet of the fluid from the low pressure volume to create a back pressure against the actuator; and counterbalancing substantially all of the forces from the back pressure against the actuator.

33. The method of claim 30, further comprising:

expressing fluid through a plurality of gaps from the outside high pressure volume to the low pressure volume; and deforming spacing elements on the valve members with the actuator to control the width of substantially all of the gaps.

34. The method of claim 30, further comprising the step of, prior to expressing, aligning adjoining pairs of valve members with annular springs, the springs being positioned within spring-grooves in the valve members in the high pressure volume.

* * * * *